US007090568B2

(12) United States Patent
Kreiselmaier et al.

(10) Patent No.: US 7,090,568 B2
(45) Date of Patent: Aug. 15, 2006

(54) BLASTING DEVICE

(76) Inventors: Richard Kreiselmaier, Chemin de Cratogne, CH-3973 Venthône (CH); Rainer Gwosdek, Auf der Dorneburg 5, D-44651 Herne (DE)

( * ) Notice: Subject to any disclaimer, the term of this patent is extended or adjusted under 35 U.S.C. 154(b) by 25 days.

(21) Appl. No.: 10/375,692

(22) Filed: Feb. 27, 2003

(65) Prior Publication Data

US 2003/0232582 A1 Dec. 18, 2003

(51) Int. Cl.
*B24C 5/02* (2006.01)

(52) U.S. Cl. ..... 451/102; 451/76

(58) Field of Classification Search ..... 451/90, 451/102, 75, 38, 39, 40, 76; 15/104.06–104.07, 15/104.05
See application file for complete search history.

(56) References Cited

U.S. PATENT DOCUMENTS

| | | | | |
|---|---|---|---|---|
| 2,532,655 A | | 12/1950 | Backer | |
| 3,055,149 A | * | 6/1962 | Luce | 451/91 |
| 3,427,763 A | | 2/1969 | Maasberg et al. | |
| 5,335,459 A | * | 8/1994 | Dale | 451/102 |
| 6,695,686 B1 | * | 2/2004 | Frohlich et al. | 451/102 |

FOREIGN PATENT DOCUMENTS

| | | | | |
|---|---|---|---|---|
| DE | 192 600 | | 11/1907 | |
| DE | 4002787 | * | 8/1991 | 451/102 |
| DE | 198 07 917 | | 8/1999 | |
| EP | 0 526 087 | | 2/1993 | |
| EP | 1 182 008 | | 2/2002 | |
| JP | 4-331073 | * | 11/1992 | 451/102 |
| SU | 449800 | * | 11/1974 | 451/76 |

* cited by examiner

*Primary Examiner*—Robert A. Rose
(74) *Attorney, Agent, or Firm*—Collard & Roe, P.C.

(57) ABSTRACT

A blasting device, especially for cleaning the surfaces of hollow areas, uses a conveying medium, preferably air, with an added solid blasting agent. The blasting device includes a twisting chamber that impresses the jet with a controlled twist. The twisting chamber has a cylindrical shape and includes a tangential inlet for the conveying medium and the blasting agent, and an outlet changing into a nozzle component conically tapering at an angle of 10° to 25°.

12 Claims, 4 Drawing Sheets

BLASTING DEVICE

BACKGROUND OF THE INVENTION

1. Field of the Invention

The present invention relates to a blasting device, in particular for cleaning the surfaces of hollow areas or cavities by means of a jet stream including a conveying or carrier medium, preferably air, and a solid blasting material added to the jet stream.

2. The Prior Art

The cleaning of surfaces by a jet of solid particles that are accelerated by means of a conveying medium, for example a carrier air stream, is a commonly-employed surface cleaning method. In the metal-processing industry, corroding unfinished parts are first cleaned by sandblasting, as a rule, before such parts are processed further. The cleaning of curved surfaces and in particular of surfaces of cavities has been found to require much expenditure. The only opening leading to the cavity is frequently small, so that blasting devices are needed that are specially adapted to the particular cavity.

A special field of application exists in the area of the cleaning of the inner surfaces of pipes especially in connection with large condensers. Particularly in the field of energy generation, the pipeline system of a condenser often has lost the desired heat transfer and the corresponding density (or concentration) due to corrosion or accumulation of dirt. Such soiling is reflected by serious losses in the degree of efficiency. The occurring loss of capacity requires a new pipeline system for the condenser in most cases, or the existing, old pipeline system has to be restored. To restore the pipeline system of a heat exchanger, it is necessary in any event to clean the inside surfaces of the pipes.

For this purpose, it is already known to clean the individual pipes from the inside by blasting with the use of a special blasting device that is axially displaced in the individual pipes. Different types of blasting agent are employed in this cleaning process. However, the blasting operation requires much time because the rate at which the blasting nozzle is employed with the axial method has to be selected sufficiently low for each individual pipe, in order to obtain the desired cleaning effect. This time-consuming cleaning operation is frequently the primary factor that determinates the time schedule within the framework of a power plant revision. The duration of the blasting operation of the individual pipes consequently has a direct effect on the availability of the power plant, and any change is connected with economic losses. Moreover, a large quantity of blasting agent is required in most cases.

For cleaning the inside surfaces of pipes in particular during a restoration of the existing pipeline system of heat exchangers, a blasting device would be desirable that can be mounted on the ends of the pipes and that dispenses the blasting agent into the pipe to be cleaned with a high spin (or twist) and at a high blasting rate. In this way, the blasting agent will clean the pipe abrasively by means of the impressed spin, and will pass in a cleaning manner over the entire length of the pipe under the pressure of the conveying medium. In a case in which different pipe widths have to be cleaned, quick adaptability of the nozzle component of a blasting device would be desirable, as it would be desirable to have the possibility for mounting the blasting device on the pipe attachment so that it projects into the starting area of the pipe to be cleaned.

Furthermore, easy exchangeability of the components of the blasting device that are stressed most would be desirable because of the strong abrasive effect exerted by the blasting agent.

SUMMARY OF THE INVENTION

In view of the drawbacks of the prior art outlined above and the pertinent requirements, the object of the invention is to further develop a blasting device of the type described above so that the duration of the cleaning process in the cleaning of the surfaces of hollow areas is substantially reduced without any deterioration of the cleaning result.

These and other objects are achieved by the blasting device according to the invention. The blasting device includes a twisting chamber that impresses the jet stream with a controlled twist. This twisting chamber has a cylindrical shape and a tangential inlet for feeding the conveying medium, as well as an outlet that is conically changing into a nozzle component that is tapering at an angle of from 10° to 25°.

A special benefit of the device as defined by the invention is that it optimally distributes the blasting agent over the surface to be cleaned. The twist that is impressed upon the flow causes a high centrifugal force to act on the individual solid particles of the blasting agent because of their higher density. This centrifugal force forces the blasting agent from the core of the flow outwards. While the blasting agent is primarily focused on the surface to be cleaned, the core flow is free of blasting agent to the highest possible degree. In the cleaning of oblong hollow bodies, the invention provides particularly high benefits. Contrary to the prior art, the cleaning effect is substantially concentrated at the given point in time on a point or line while nonetheless cleaning a larger surface area at the same time. Due to the superior way in which use is made of the blasting agent and the shortened blasting duration, substantially lesser total amounts of the blasting agent are required as well.

According to the invention, the twisting chamber has a cylindrical shape. The cylindrical form of the twisting chamber offers the benefit that a flow can develop in the peripheral direction with only low loss of flow. The desired twist is obtained rapidly and uniformly in this manner.

The twisting chamber has a tangential inlet for the blasting agent. If the twist is impressed upon the flow in this manner, no additional means for guiding the flow are required. For example, there is no need for flow baffles arranged in a helical configuration. The area afflicted with a boundary layer is minimized in this manner, and loss of pressure in the twisting chamber is kept at a low level.

The tangential inlet for admitting the blasting agent, which itself includes conveying medium and blasting agent, is preferably inclined in the direction of the axis of the blasting jet. The angle in relation to the axis of the jet preferably amounts to 30° to 60°, and in particular to about 45°. The abrasion in the twisting chamber is reduced in this manner. The blasting agent is provided with a directional component toward the outlet already when it enters the twisting chamber.

If the outlet of the spin generator is designed in the form of a component of the nozzle, the flow is provided with additional acceleration in the main direction of flow. Furthermore, the flow rate in the peripheral direction is raised because the diameter is reduced while the twist, however, remains constant.

For this purpose, the nozzle component is a part of the construction that is tapering at an angle of 10° to 25°. In particular, the angle of the taper amounts to about 15°. This represents an optimum between the (desired) acceleration and the (undesired) abrasive effect of the blasting medium.

In an advantageous embodiment, the nozzle component of the blasting device is formed as a separate component that is connected with the twisting chamber and can be replaced. In this way, the nozzle component may be adapted to the diameter of the pipe to be cleaned. For this purpose, the twisting chamber and the nozzle component are usefully provided with suitable threads or a suitable interlocking device.

In another beneficial embodiment, the nozzle component is provided on the outlet opening with an additional nozzle tube that in turn can be screwed to or interlocked with the nozzle component. The nozzle tube itself has a fully cylindrical shape and, with the blasting device mounted on a pipe, is intended to project into the pipe and to reliably blow the blasting medium into the interior of the pipe to be cleaned.

For the purpose of impressing a particularly forceful spin on the flow in the twisting chamber, it is useful if the inlet leading into the twisting chamber is embodied in the form of a nozzle as well. The flow so accelerated is deflected in the peripheral direction as it enters the twisting chamber, which results in a more forceful twist because of a higher inlet rate.

In order for the flow to perform a nearly undisturbed motion in the twisting chamber in the peripheral direction, it is particularly beneficial if the inlet opening leading into the twisting chamber has a larger expanse in the axial than in the peripheral direction. In this way, the circular flow developing in the twisting chamber is provided with a tangential driving pulse by the entering medium without subjecting the circular motion to any notable disturbance.

So that the spin will develop in the twisting chamber in a particularly uniform and low loss manner, it is useful if an oblong displacement body is coaxially arranged in the twisting chamber. In this way, the quantity of the twist component of the flow can be adjusted as desired by means of this displacement body.

So that the useful life of the blasting device as defined by the invention will be particularly long, it is beneficial if the inner surface of the twist generator is made of metal or ceramics, in particular oxide ceramics. Being a highly stressed structural component, the twist generator should be particularly resistant to wear. The forceful deflection of the flow puts high stress on the surfaces especially if the blasting medium has already been added.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings.

DETAILED DESCRIPTION OF PREFERRED EMBODIMENTS

Figure 1:
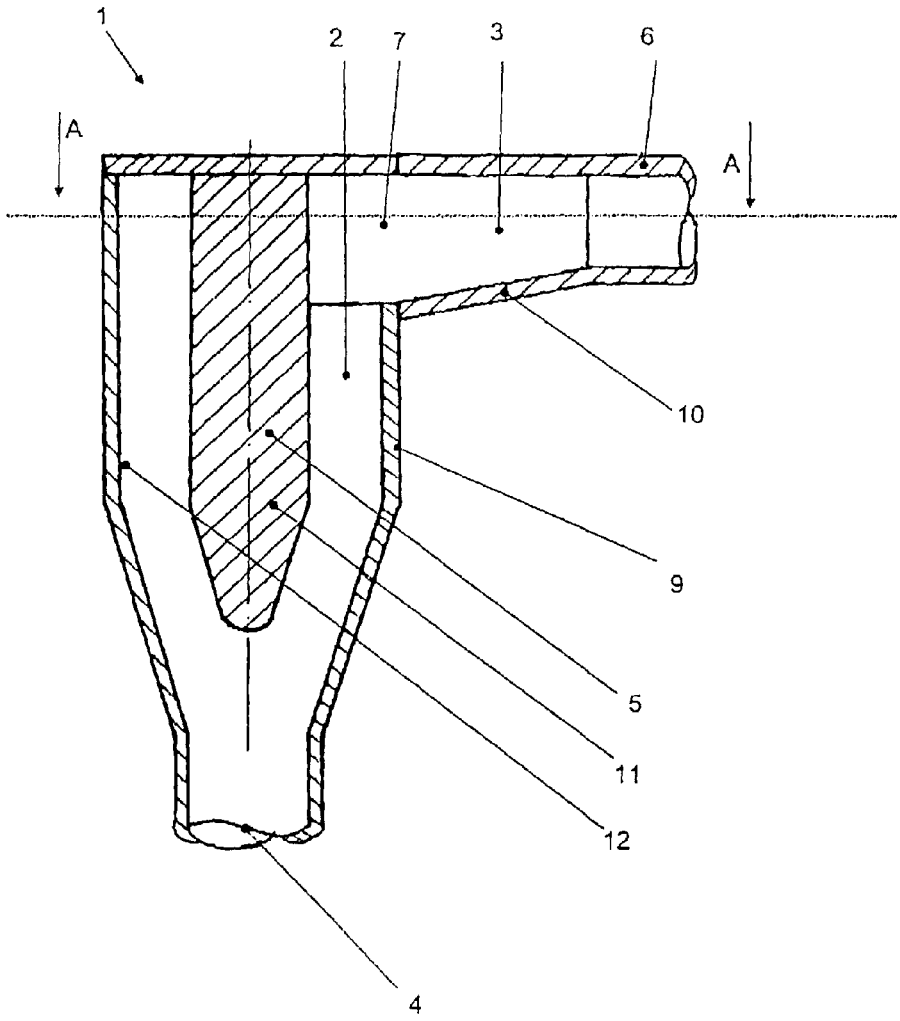
FIG. 1 is a longitudinal section through a blasting device according to an embodiment of the invention.
Figure 2:
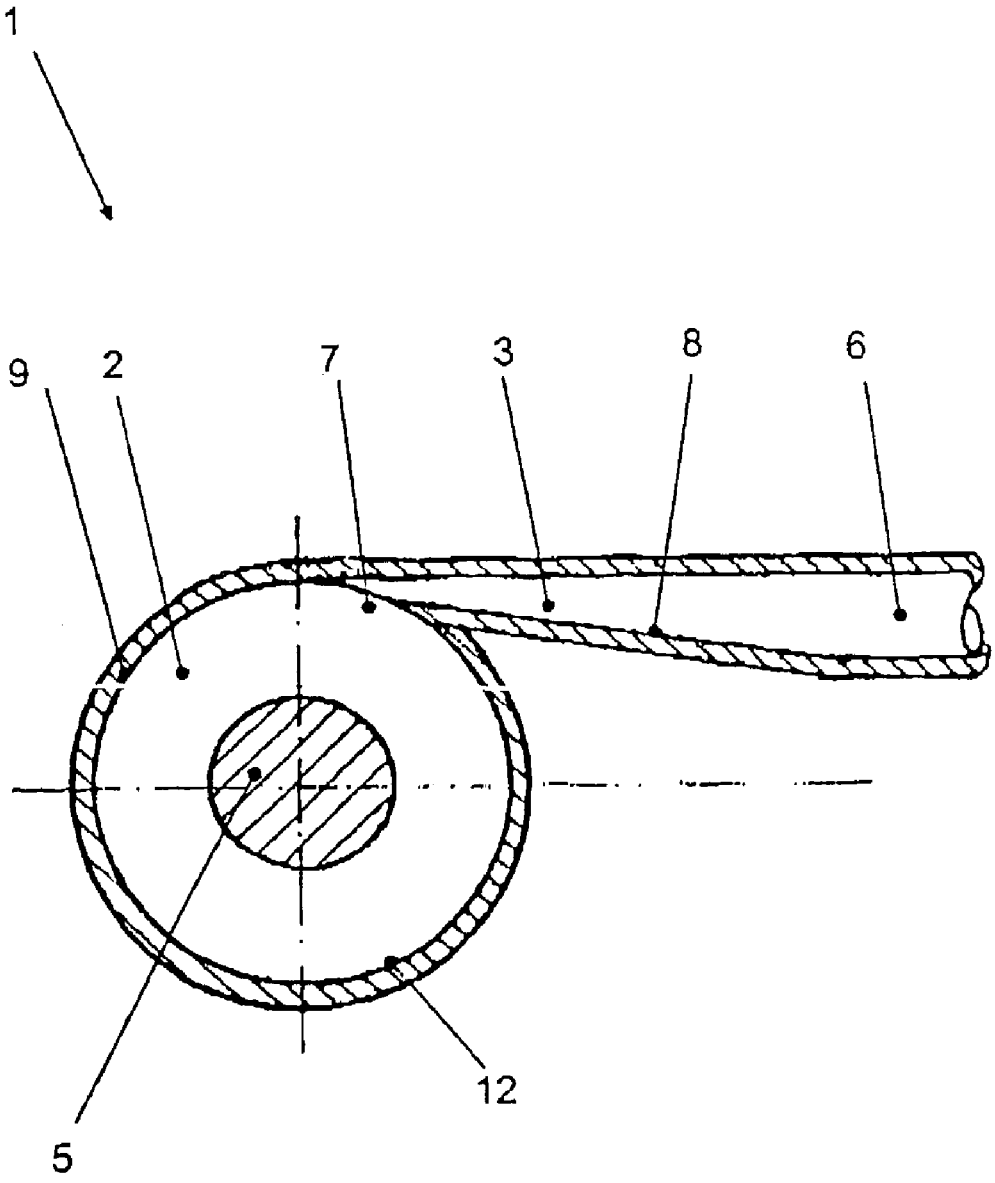
FIG. 2 is a cut top view of the blasting device of FIG. 1.

Turning now in detail to the drawings, FIG. 1 shows a blasting device 1 cut in the longitudinal direction, including a twisting chamber 2 with an inlet 3 and an outlet 4. A cross section through this blasting device according to section A—A is shown in FIG. 2.

An oblong, cylindrical displacement body 5 is coaxially arranged in twisting chamber 2. The intake takes place via a tube 6 that is tapered toward inlet 3 leading into twisting chamber 2, up to an inlet opening 7 leading into the twisting chamber. Inlet 3 is tapering only on the side 8, which is disposed near to the center of the blasting device. The other side of inlet 3 constantly changes tangentially into the wall 9 of twisting chamber 2. On the side 10, inlet 3 widens upstream of inlet opening 7 leading into twisting chamber 2, side 10 pointing in the direction of the main flow in twisting chamber 2. Displacement body 5 is tapered in the form of a cone at the end 11, which is pointing in the direction of the main flow. The angles of opening of displacement body 5 at end 11 pointing in the direction of the main flow, and on outlet 4 of twisting chamber 2, are nearly identical. On its inside surface 12, the blasting device is coated with oxide ceramics. The conveying medium may flow through the blasting device either with the blasting medium already added, or without the blasting medium. A nozzle tube may adjoin the blasting device depending on the case of application.

Figure 3:
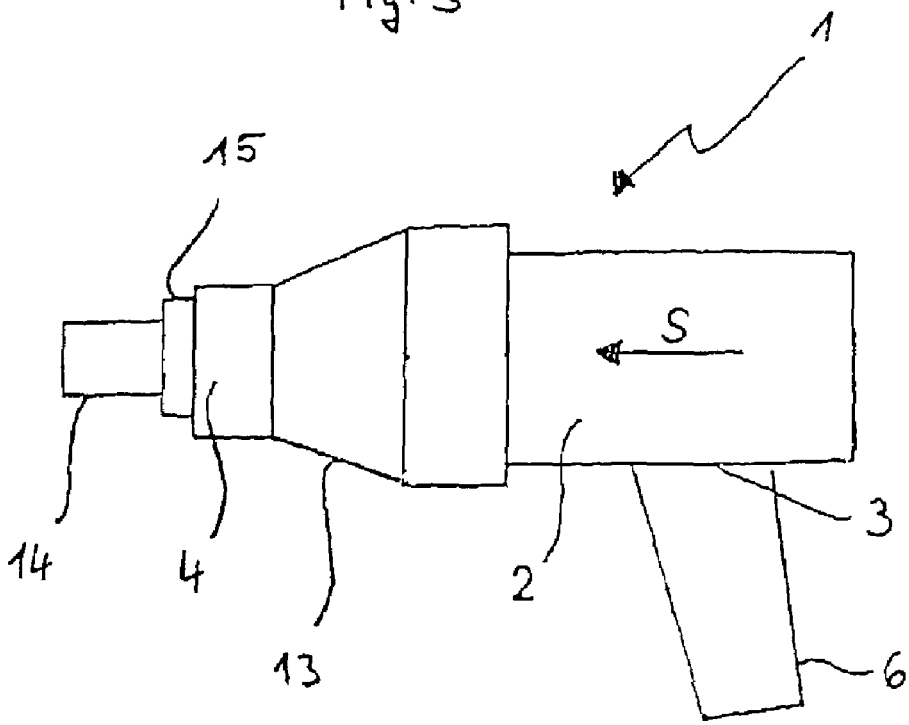
FIG. 3 is a preferred embodiment of a blasting device as defined by the invention, with a mounted nozzle component and an inserted nozzle tube.

FIG. 3 shows another preferred embodiment of the blasting device as defined by the invention. Twisting chamber 2 has a tangentially arranged feed tube leading into the twisting chamber for feeding the mixture of conveying medium and blasting agent. This feed tube feeds into chamber 2 at point 3. A nozzle component 13 that is screwed to twisting chamber 2 is located in the jet direction "S". Component 13 is conically tapering in the direction of outlet opening 4. Within the area of outlet opening 4, a nozzle tube 14 is screwed into the nozzle component 13 via a ring fastener 15. The nozzle tube is made of a conventional oxidic material, for example corundum, and provides high resistance to the effect of the jet.

Figure 4:
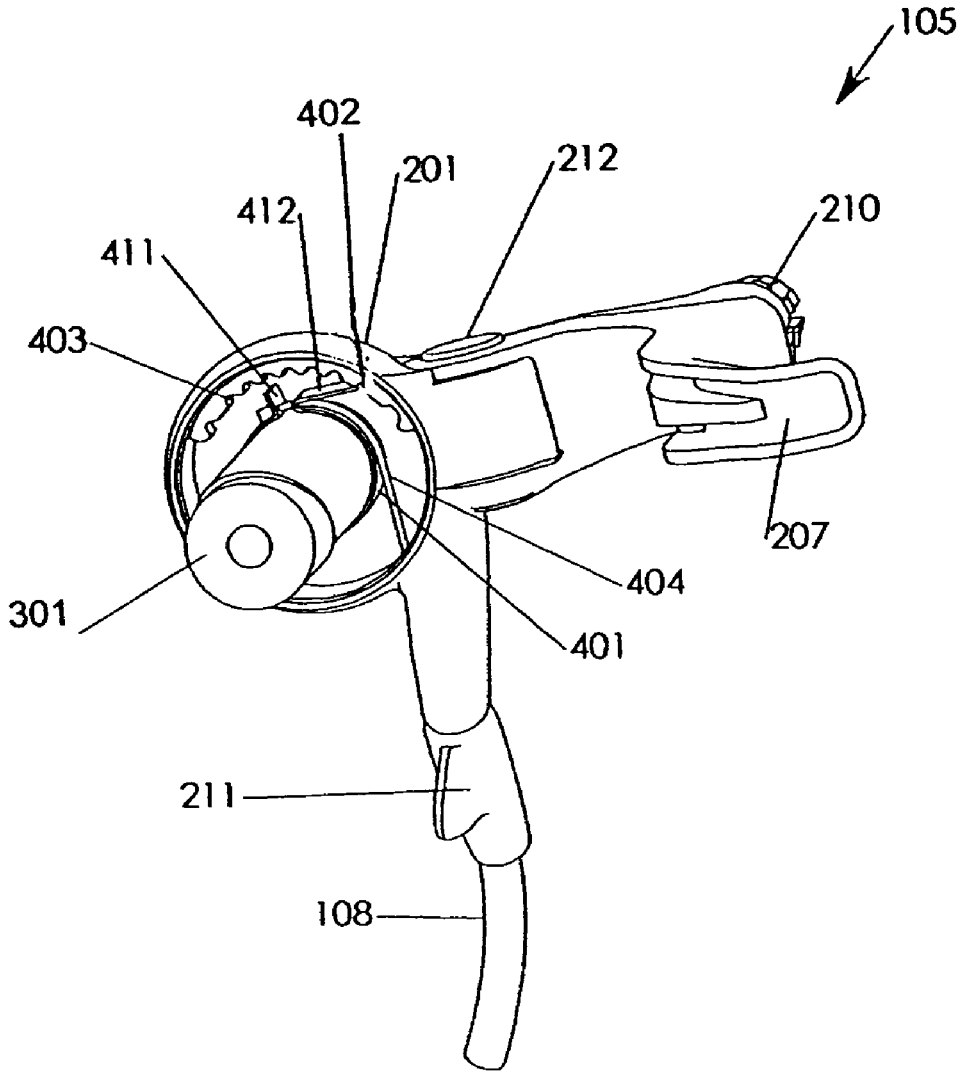
FIG. 4 is a section through the blasting device according to FIG. 3.

FIG. 4 shows a section through blasting device 1 according to FIG. 3, with the feed 6 for admitting the conveying medium and the blasting agent feeding to the rear of the plane of the paper at 3. Chamber 2 preferably has a wall 9 made of a resistant material that may be coated, for example with a hard oxidic ceramic material as well.

The displacement body shown in FIGS. 1 and 2 is absent from the embodiment according to FIG. 4.

Twisting chamber 2 changes into a conically expending nozzle component 13 that is provided with increased wall thickness in order to prolong the useful life. This nozzle component is preferably a wear part made of steel, preferably stainless steel, and is screwed on, so that is can be quickly replaced at favorable cost. The opening angle versus the walls of cylindrical twisting chamber 2 preferably amounts to about 15°.

A nozzle tube 14 is screwed into the area of the outlet of the nozzle part 4 by means of a mounting device 15 such as an intermediate ring fastener. This nozzle tube is preferably made of aluminum oxide or corundum and adapted to being inserted in the inlet area of a pipe to be cleaned.

The embodiment of the blasting device, with nozzle component 13, intermediate ring 15 and nozzle tube 14 unscrewed, permits worn elements to be quickly replaced. It also allows quick adaptation of the blasting device to the inside diameter of the hollow pipes to be cleaned. The outside diameter of nozzle tube 14 can be varied via intermediate piece 15 and outlet opening 4 can be made wider or narrower accordingly by selecting suitably sized nozzle components 13.

Accordingly, while a few embodiments of the present invention have been shown and described, it is to be understood that many changes and modifications may be made thereunto without departing from the spirit and scope of the invention as defined in the appended claims.

What is claimed is:

1. A blasting device for cleaning surfaces of hollow areas by means of a jet stream comprising a conveying medium and particles of a blasting agent added to the conveying medium, which comprises:

(a) a twisting chamber having a cylindrical shape;

(b) a tangential inlet leading into the twisting chamber for admitting the conveying medium and the blasting agent, the conveying medium and the blasting agent being introduced into the twisting chamber entirely through said tangential inlet;

(c) a nozzle part conically tapering at an angle of 10° to 25° leading out of the twisting chamber, the jet stream exiting the nozzle part as a flow of blasting agent and conveying medium; and (d) an oblong, cylindrical displacement body coaxially arranged in the twisting chamber;

wherein the twisting chamber provides the jet stream with a controlled twist and the entire flow of blasting agent and conveying medium exiting the nozzle part is introduced into the twisting chamber through the tangential inlet.

2. The blasting device according to claim 1, wherein the conveying medium comprises air.

3. The blasting device according to claim 1, wherein the nozzle part tapers at an angle of about 15°.

4. The blasting device according to claim 1, wherein the tangential inlet leading into the twisting chamber is inclined by an angle of 30° to 60° in relation to an axis of the jet stream.

5. The blasting device according to claim 4, wherein the tangential inlet leading into the twisting chamber is inclined by an angle of about 45° in relation to the axis of the jet stream.

6. The blasting device according to claim 1, wherein the nozzle part is a separate structural component connected with the twisting chamber.

7. The blasting device according to claim 6, wherein the nozzle part is screwed to or interlocked with the twisting chamber.

8. The blasting device according to claim 1, wherein the nozzle part has a nozzle tube on an outlet opening of the nozzle part.

9. The blasting device according to claim 8, wherein the nozzle tube is screwed to or interlocked with the nozzle part.

10. The blasting device according to claim 8, wherein the nozzle tube is made of corundum.

11. The blasting device according to claim 1, wherein the displacement body is conically tapered in the direction of the jet stream.

12. The blasting device according to claim 1, wherein the nozzle part is made of steel.

* * * * *